US006445112B1

(12) United States Patent
Amrein et al.

(10) Patent No.: US 6,445,112 B1
(45) Date of Patent: Sep. 3, 2002

(54) LAMP COATED WITH AN IRON-OXIDE PIGMENT, ORGANIC COLORING MATERIAL AND SILICON-OXYGEN COMPOUND LAYERS

(75) Inventors: Thomas Amrein, Aachen (DE); Kees Denissen, Nuth (NL); Bertrand Gorisse, Chartres (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 209 days.

(21) Appl. No.: 09/645,064

(22) Filed: Aug. 24, 2000

(30) Foreign Application Priority Data

Sep. 1, 1999 (DE) ..... 199 41 531

(51) Int. Cl.[7] ..... H01J 5/16; H01J 63/02; H01K 1/26

(52) U.S. Cl. ..... 313/110; 313/112; 313/489; 313/580; 313/635

(58) Field of Search ..... 313/112, 580, 313/489, 635

(56) References Cited

U.S. PATENT DOCUMENTS

2001/0043033 A1 * 11/2001 Ruemmelin et al. ..... 313/112
2002/0014819 A1 * 2/2002 Ozawa et al. ..... 313/112
2002/0024278 A1 * 2/2002 Matsuda et al. ..... 313/112

FOREIGN PATENT DOCUMENTS

JP 60116958 6/1985 ..... F16H/35/00

* cited by examiner

*Primary Examiner*—Michael H. Day
*Assistant Examiner*—Glenn Zimmerman
(74) *Attorney, Agent, or Firm*—Dicran Halajian

(57) ABSTRACT

Colored luminaire, in particular a signal luminaire for motorcars, having a lamp and a cover, wherein the lamp includes a bulb having a coating composed of a first layer containing an iron-oxide pigment, a second layer containing an organic coloring material, and a transparent layer which is arranged between the first and the second layer and which contains a silicon-oxygen compound.

7 Claims, No Drawings

LAMP COATED WITH AN IRON-OXIDE PIGMENT, ORGANIC COLORING MATERIAL AND SILICON-OXYGEN COMPOUND LAYERS

BACKGROUND OF THE INVENTION

The invention relates to a colored luminaire, in particular a colored signal luminaire for motorcars, which includes a lamp and a cover, wherein the lamp comprises a bulb provided with a coating including a layer containing an iron-oxide pigment.

Colored luminaires are used at different locations in motorcars, where they are used, for example, for brake lights, turn signal lamps and fog lamps. In conventional, colored luminaires the bulb of the lamp is made of clear glass and the lamp is arranged under a colored, generally red or yellow, luminaire cover. More recently, there is a tendency to use, for the colored luminaires, colored lamps under a cover that is either colorless or of a uniform neutral color. This enables signal lamps of different colors to be mounted as a lamp ensemble under a uniform cover.

Luminaires comprising colored lamps under a cover that is either colorless or of a uniform neutral color have the advantage that they enable a flexible, optically attractive design for integrated front and rear luminaires. In addition, they are cheaper than luminaires having a multicolor housing or multicolor covers. In addition, these luminaires contribute to a higher traffic safety because the difference between the "on" and the "off"-state of the lighting at daylight can be more readily distinguished with lights comprising colored lamps situated under a cover which is either colorless or of a neutral color.

For the colored, pigment-containing bulb coating of colored lamps use can be made, in principle, of inorganic or organic color pigments. The well-known bulb coatings comprising red and yellow inorganic color pigments are stable for a long period of time, however, their color value leaves to be desired. JP 52063235 discloses, for example, an electrostatic coating for bulbs comprising a mixture of iron oxide powder having an average grain diameter in the range from 0.2 to 2.0 $\mu$m and 20 to 95% by weight silicon oxide powder. Bulb coatings comprising organic pigments, for example the coatings described in JP-A-60 116958 comprising red pigments of the group of the anthraquinone pigments, can be optimized as regards the color co-ordinates, however, they turn yellow in the course of time.

As in many other branches of industry, there is a trend to make lighting equipment in motorcars lamp smaller and smaller. Attempts are made to reduce the size of the entire lighting equipment used in a motorcar and, for example, integrate the signal luminaires into the headlights. In such lighting units, the lamps are exposed, however, to higher thermal loads.

SUMMARY OF THE INVENTION

It is an object of the invention to provide a colored luminaire comprising a lamp and a cover, wherein the lamp includes a bulb having a coating containing an iron-oxide pigment, which luminaire has a long service life, also at increased ambient temperatures, as well as optimum color co-ordinates, and can suitably be used for a motorcar lighting unit.

In accordance with the invention, this object is achieved by a colored luminaire, comprising a lamp and a cover, wherein the lamp comprises a bulb having a coating of a first layer containing an iron-oxide pigment, a second layer containing an organic coloring material, and a transparent layer which is arranged between the first and the second layer and which contains a silicon-oxygen compound. By virtue of the combination of an iron-oxide pigment and an organic coloring material, the standard color value for signal luminaires, which is established for Europe by the E.C.E. and for the United States by the S.A.E., can be readily attained, whereas it is impossible to attain this standard color value when only a pigment is used. The layer comprising a silicon-oxygen compound provides for an improved bonding of the layer with respect to both the first and the second layer, as well as a smaller change in color value in the course of time and hence a longer service life of the bulb coating with respect to a bulb coating comprising only a pigment-containing layer. Also under extreme operating conditions, no chemical changes occur in the iron-oxide layer, which can be attributed to the fact that said layer is protected by the two layers overlying it when the iron-oxide layer is provided as an inner layer.

Within the scope of the invention, it is preferred that the organic coloring material is a pigment of the group formed by the azo pigments, anthraquinone pigments, pyrazolone pigments and triarylmethane pigments.

It is particularly preferred that the organic coloring material is a metal complex dye. These transparent metal complex dyes enable a desired standard color value to be attained already in a very thin layer. Layers containing a metal complex dye demonstrate a very good adhesion to layers containing a silicon-oxygen compound.

Within the scope of the invention, it is preferred that the iron-oxide pigment is a hematite pigment. Even when the layer, which contains an organic coloring material, is damaged, the luminaire still generates a colored signal light which matches the tone of the brownish-red hematite.

The invention is particularly advantageous with respect to the known state of the art when the iron-oxide pigment is a transparent iron oxide. Particularly the yellow to orange transparent iron-oxide pigments can change color when the temperature is increased. However, the transparent layer, which contains a silicon-oxygen compound, precludes this change in color. On the other hand, when the coating structure is such that the layer containing a transparent iron-oxide pigment is situated on the outside, and the layer containing an organic coloring material is situated on the inside, the iron-oxide layer protects the organic coloring material and, in particular, also the binder in the underlying layer from the influence of UV radiation, thereby increasing the service life of the lamp.

It may alternatively be preferred that the bulb comprises a transparent covering layer which contains a silicon-oxygen compound. When the coating is applied inside the bulb, the covering layer precludes that the coating is subject to chemical change. If the coatings are applied on the outside, then the covering layer forms a scratch-resistant surface which makes further processing of the bulb in the lamp production process easier. Preferably, use is made of a covering layer having a suitable refractive index so as to reduce scattering of the pigment-containing layers.

The invention also relates to a lamp comprising a bulb having a coating composed of a first layer containing an iron-oxide pigment, a second layer containing an organic coloring agent, and a transparent layer containing a silicon-oxygen compound, which transparent layer is situated between the first and the second pigment-containing layer.

DETAILED DESCRIPTION OF THE INVENTION

These and other aspects of the invention will be apparent from and elucidated with reference to the embodiment(s) described hereinafter.

A colored luminaire in accordance with the invention is provided with a lamp and a cover, which lamp comprises a bulb having a coating composed of a first layer containing an iron-oxide pigment, a second layer containing an organic coloring material, and a transparent layer which is arranged between the first and the second layer and which contains a silicon-oxygen compound.

The layer sequence of the coating may be such that the bulb, which serves as the substrate, is first provided with the iron-oxide pigment-containing layer and then with the two other layers. However, the layer sequence may also be reversed, so that the bulb, which serves as the substrate, is first provided with the layer containing an organic coloring agent. Dependent upon the structural shape of the lamp, the coating may be applied to one or more walls, i.e. both on the inside and the outside, of the lamp bulb. The bulb may also be provided, on the outside, on top of the other layers, with a transparent covering layer containing the silicon-oxygen compound.

The colored luminaire may also be provided with other components, for example attaching means, means protecting against dust, damage and moisture, as well as energy-supply components, for example lamp holders, conductors, ballasts, starters, ignition devices, connection terminals. A desired light distribution and a limitation of the glare can be obtained by means of optical reflectors, clear or opaque closing troughs, grids of metal or synthetic resin, scattering screens and prisma reflectors. In accordance with an embodiment of the invention, the luminaire comprises two or more colored lamps situated under a common cover, which covers are either colorless or of a neutral color.

For the first pigment-containing layer, use is made of iron-oxide pigments. Iron-oxide pigments have a wide color spectrum from yellow via orange to red, brown and black. The natural and synthetic iron-oxide pigments used consist of well-defined compounds of known crystal structure. $\alpha$-$Fe_2O_3$ (hematite) with a corundum structure changes its color from bright red to dark violet as the particle size increases. Y—$Fe_2O_3$ (maghemite) with a spinel structure is brown in color. $\alpha$-FeOOH (goethite) having a diaspore structure changes its color from bright yellow to brownish yellow as the particle size increases. Y—FeOOH (lepidocrocite) having a boehmite structure changes its color from yellow to orange as the particle size increases. These iron oxides are iron(III) oxides. The red violet to black $Fe_3O_4$ (magnetite) having a spinel structure can only suitably be used in exceptional cases.

The pigments and coloring agents will hereinafter be denoted in accordance with their chemical composition and/or the Color Index (C.I.), which is jointly published by the Society of Dyers and Colourists and the American Association of Textile Chemists and Colorists.

Transparent yellow iron oxide, C.I. pigment yellow 42:77492 is $\alpha$-FeOOH (goethite) with a diaspore structure. Upon heating, it converts to the preferably used transparent brownish red $\alpha$-$Fe_2O_3$ (hematite), C.I. pigment red 101:77491. Orange intermediate shades develop in the course of a short temperature treatment. They can also be obtained by mixing yellow and red pigments. Preferably, the transparent iron-oxide pigments are used in a fine-particle, colloid form having a grain size of 2 nm<d<15 nm to obtain transparent layers.

The intermediate layer comprises a silicon-oxygen compound, for example amorphous or crystalline silicon dioxide, quartz, a silica gel or a silicic acid or a silicate, i.e. salts or esters of the silicic acids, in particular tetraethylorthosilicate (TEOS).

The second layer may comprise an organic pigment from the group of the azo pigments, anthraquinone pigments, pyrazolone pigments and triarylmethane pigments.

Azo pigments have the general structural formula $R_1N=NR_2$, where $R_1$ and $R_2$ are aromatic, heteroaromatic residues or residues derived from methylene-active compounds. Monoazo pigments and diazo pigments having yellow, orange, red or brown shades are preferred.

Anthraquinone pigments are pigments whose basic structure is derived from anthraquinone. These pigments include amino-anthraquinone and hydroxy-anthraquinone pigments, heterocyclic and polycarbocyclic anthraquinone pigments, for example anthrapyrimidine, indanthrone, flavanthrone, pyranthrone, anthanthrone and isoviolanthrone pigments.

Pyrazolone pigments are azo pigments with substituted pyrazolones as coupling components and benzidines or substituted anilines as diazo components.

Triarylmethane pigments are organic pigments having a cationic triarylcarbenium structure, where at least two of the aryl residues are substituted with amino groups.

The second layer may preferably also comprise a metal-complex dye, i.e. a dye in which bidentate or multidentate ligands in chelate form are linked to a central metal ion, preferably Cr, Co, Cu or nickel. Azo compounds and phtalocyanines, whose oxygen or nitrogen atoms take part in the chelate linkage, are preferred. Particularly preferred are 1:1 and 1:2 complexes of chromium(II), for example the metal complex dyes SY 82 and SY 56. The dye can be applied in a cellulose nitrate lacquer for incandescent lamps, which, apart from cellulose nitrate, comprises an alkyd resin and trikresol phosphate as well as xylene as the solvent.

The covering layer comprises a silicon-oxygen compound, for example amorphous or crystalline silicon dioxide, quartz, a silica gel or a silicic acid or a silicate, i.e. salts or esters of the silicic acids, in particular tetraethylorthosilicate (TEOS). Alternatively, this additional covering layer may be a temperature-resistant, transparent, colorless lacquer or a transparent ceramic layer of, for example, $Al_2O_3$ or enamel.

The different layers can be manufactured by means of dry coating methods, such as electrostatic deposition or electrostatically assisted dusting as well as wet coating methods, such as dip coating or spraying.

For wet coating methods, the pigments must be dispersed in water, an organic solvent, if necessary in combination with a dispersing agent, a surface-active agent and an anti-foaming agent, or a binder additive. Suitable binder additives for a luminaire in accordance with the invention are organic or inorganic binders which are capable of withstanding an operating temperature of 250° C. without decomposing, embrittling or discoloring.

For binder-free pigment coatings, a layer thickness in the range from 0.5 to 1 $\mu$m may be sufficient. Binder-containing layers generally have a layer thickness in the range from 1 to 50 $\mu$m.

EXAMPLE

To manufacture the bulb coating, first a dispersion of 15.0 wt. % transparent iron-oxide pigment PR 101, 0.75 wt. % sodium polyacrylate as the dispersing agent, 0.075 wt. % (?)

polyethylene propylene oxide as the anti-foaming agent are wet grounded with water in an agitated grinder until the agglomerated pigment is dispersed. The purified and baked lamp bulbs are immersed in this dispersion and subsequently burned in at 480° C. A quantity of 180 g tetraethylorthosilicate is mixed with 2077 g ethanol, 146 g 1 n hydrochloric acid and 27 ml of an anionic surface-active agent. The precoated lamp bulbs are immersed in this mixture and baked at a temperature of at least 450° C. so as to convert tetraethylorthosilicate into a silicon dioxide layer. Subsequently, the lamp bulbs thus pretreated are immersed in a 25% solution of SY 82 in xylene containing cellulose nitrate, alkyd resin and trkesyl phosphate in a ratio of 1:0.5:0.6, and subsequently dried.

The coated lamp is exposed to an accelerated thermal load test, where the lamp is permanently exposed to a temperature of 250° C. Within a period of 500 hours, the color location changed only to a very small degree within the color specification range determined by the E.C.E. and S.A.E.

What is claimed is:

1. A colored luminaire, comprising a lamp and a cover, wherein the lamp comprises a bulb having a coating composed of a first layer containing an iron-oxide pigment, a second layer containing an organic coloring material, and a transparent layer which is arranged between the first and the second layer and which contains a silicon-oxygen compound.

2. A colored luminaire as claimed in claim 1, wherein the organic coloring material is a pigment from the group formed by the azo pigments, anthraquinone pigments, pyrazolone pigments and triarylmethane pigments.

3. A colored luminaire as claimed in claim 1, wherein the organic coloring material is a metal complex dye.

4. A colored luminaire as claimed in claim 1, wherein the iron-oxide pigment is a hematite pigment.

5. A colored luminaire as claimed in claim 1, wherein the iron-oxide pigment is a transparent iron oxide pigment.

6. A colored luminaire as claimed in claim 1, wherein the bulb comprises a transparent covering layer which contains a silicon-oxygen compound.

7. A lamp comprising a bulb having a coating composed of a first layer containing an iron-oxide pigment, a second layer containing an organic coloring material, and a transparent layer containing a silicon-oxygen compound, which layer is situated between the first and the second layers.

* * * * *